US007699163B2

(12) United States Patent
Gomes et al.

(10) Patent No.: US 7,699,163 B2
(45) Date of Patent: Apr. 20, 2010

(54) CARTON WITH SUPPORT

(75) Inventors: Jean-Manuel Gomes, Marietta, GA (US); Graham Hand, Roswell, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 863 days.

(21) Appl. No.: 11/405,052

(22) Filed: Apr. 17, 2006

(65) Prior Publication Data

US 2006/0231441 A1 Oct. 19, 2006

Related U.S. Application Data

(60) Provisional application No. 60/671,779, filed on Apr. 15, 2005, provisional application No. 60/672,439, filed on Apr. 18, 2005.

(51) Int. Cl.

| | |
|---|---|
| ***B65D 75/00*** | (2006.01) |
| ***B65D 65/00*** | (2006.01) |
| ***B65D 5/50*** | (2006.01) |
| ***B65D 5/46*** | (2006.01) |
| ***B65D 17/00*** | (2006.01) |

(52) U.S. Cl. ..... 206/162; 206/756; 206/170; 206/427; 206/200; 229/242; 229/243; 229/117.14

(58) Field of Classification Search ..... 206/162, 206/170, 427, 756, 759, 760, 764–765, 774, 206/428, 747; 229/242, 243, 117.14
See application file for complete search history.

(56) References Cited

U.S. PATENT DOCUMENTS

| | | | | |
|---|---|---|---|---|
| 3,640,448 | A | 2/1972 | Wood | |
| 3,963,121 | A | 6/1976 | Kipp | |
| 4,836,375 | A | 6/1989 | Schuster | |
| 5,000,313 | A | 3/1991 | Oliff | |
| 5,180,054 | A | 1/1993 | Bakx | |
| 5,351,878 | A | 10/1994 | Cooper | |
| 5,549,197 | A | 8/1996 | Sutherland | |
| 5,899,377 | A | 5/1999 | Speese et al. | |
| 6,029,886 | A | 2/2000 | Sheffer | |
| 6,341,689 | B1 * | 1/2002 | Jones | 206/175 |
| 6,422,454 | B1 * | 7/2002 | Barr et al. | 229/117.14 |
| 6,848,573 | B2 * | 2/2005 | Gould et al. | 206/141 |
| 7,097,034 | B2 * | 8/2006 | Woog | 206/427 |

FOREIGN PATENT DOCUMENTS

| | | |
|---|---|---|
| DE | 80 22 379.6 | 10/1981 |
| FR | 1 324 316 | 4/1963 |
| FR | 2 549 010 | 1/1985 |
| FR | 2 841 216 | 12/2003 |

(Continued)

*Primary Examiner*—Mickey Yu
*Assistant Examiner*—Melissa L Lalli
(74) *Attorney, Agent, or Firm*—Womble Carlyle Sandridge & Rice, PLLC

(57) ABSTRACT

A carton for containing a plurality of articles. The carton has panels that extend at least partially around an interior of the carton. The panels include a top panel, a bottom panel and a first side panel and a second side panel. The carton has a support adjacent to the top panel and projecting into the interior of the carton for at least partially supporting the plurality of articles within the carton.

22 Claims, 5 Drawing Sheets

FOREIGN PATENT DOCUMENTS

| | | |
|---|---|---|
| GB | 1242723 | 8/1971 |
| GB | 1 395 644 | 5/1975 |
| GB | 2 115 383 A | 9/1983 |
| NZ | 509745 | 8/2003 |
| WO | WO 00/76863 A1 | 12/2000 |

* cited by examiner

CARTON WITH SUPPORT

CROSS-REFERENCE TO RELATED APPLICATIONS

This application claims the benefit of both U.S. Provisional Application Ser. No. 60/671,779, filed Apr. 15, 2005 and entitled "Single Lane Dispenser for Bottles with a Top Cap Retainer" and U.S. Provisional Application Ser. No. 60/672,439, filed Apr. 18, 2005 and entitled "Single Lane Dispenser for Bottles with a Top Cap Retainer", the entire contents of both of which are hereby incorporated by reference as if presented herein in their entirety.

BACKGROUND OF THE INVENTION

The present invention generally relates to cartons for holding and dispensing beverage containers or other types of articles. More specifically, the present invention relates to cartons having a support for supporting the top of the articles to keep the articles in an upright position for dispensing from the carton.

Fully enclosed cartons that are capable of carrying containers have been used in the past that have a dispenser for dispensing the containers from the carton. When bottles or other non-cylindrical containers are enclosed in a typical carton, the tops of the bottles are free from contact with the sides of the carton so that the bottles are unrestrained and capable of movement between the side walls of the carton. When the bottles are dispensed from the cartons it is frequently difficult to grasp the unrestrained bottles in the carton. As such, an enclosed carton is needed having a support that supports the containers in the carton so that the containers remain positioned for dispensing from the carton.

SUMMARY OF THE INVENTION

An exemplary embodiment of the present invention generally relates to a single lane carton with at least one dispensing feature and that is capable of holding containers or other types of products. Generally, the carton of the exemplary embodiment of the present invention holds products that benefit from support around their top while housed in the carton. These support features are also useful to keep the bottles positioned during dispensing, and provide support in the top for articles such as bottles, wine bottles, or the like.

In general, one embodiment of the present invention is directed to a carton for containing a plurality of articles. The carton has panels that extend at least partially around an interior of the carton. The panels include a top panel, a bottom panel and a first side panel and a second side panel. The carton has a support adjacent to the top panel and projecting into the interior of the carton for at least partially supporting the plurality of articles within the carton.

In another aspect, the present invention is generally directed to a blank for forming a carton having a support for supporting a plurality of articles. The blank comprises a plurality of panels including a top panel, a bottom panel, a first side panel and a second side panel. End flaps are respectively foldably attached to respective panels of the plurality of panels, wherein the end flaps at least partially form a closed end of the carton. A support panel is foldably attached to the top panel for being formed into a support for at least partially supporting the plurality of articles in a carton erected from the blank.

In yet another aspect, the present invention is directed to a method of forming a carton from a blank comprising providing a blank comprising a top panel, a bottom panel, a first side panel and a second side panel, and a support panel foldably attached to the top panel. The support is formed by folding the support panel relative to the top panel. The support panel is attached to the top panel. A sleeve is formed that extends at least partially around the support.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to cartons housing a plurality of articles and a support in the carton for supporting the articles, such as in a position to be dispensed from the carton. The present invention can be used, for example, in cartons that contain articles or other products such as, for example, food and beverages or pet food. The articles can also include soup cans or other food or beverage containers such as, for example, cans, bottles, PET containers, or other containers such as those used in packaging foodstuffs. For the purposes of illustration and not for the purpose of limiting the scope of the present invention, the following detailed description describes containers, such as bottles, being generally cylindrical and having a wide bottom and a narrow top, as disposed within the carton embodiments. In this specification, the relative terms "lower," "bottom," "upper" and "top" indicate relative orientations determined in relation to fully erected cartons.

Figure 1:
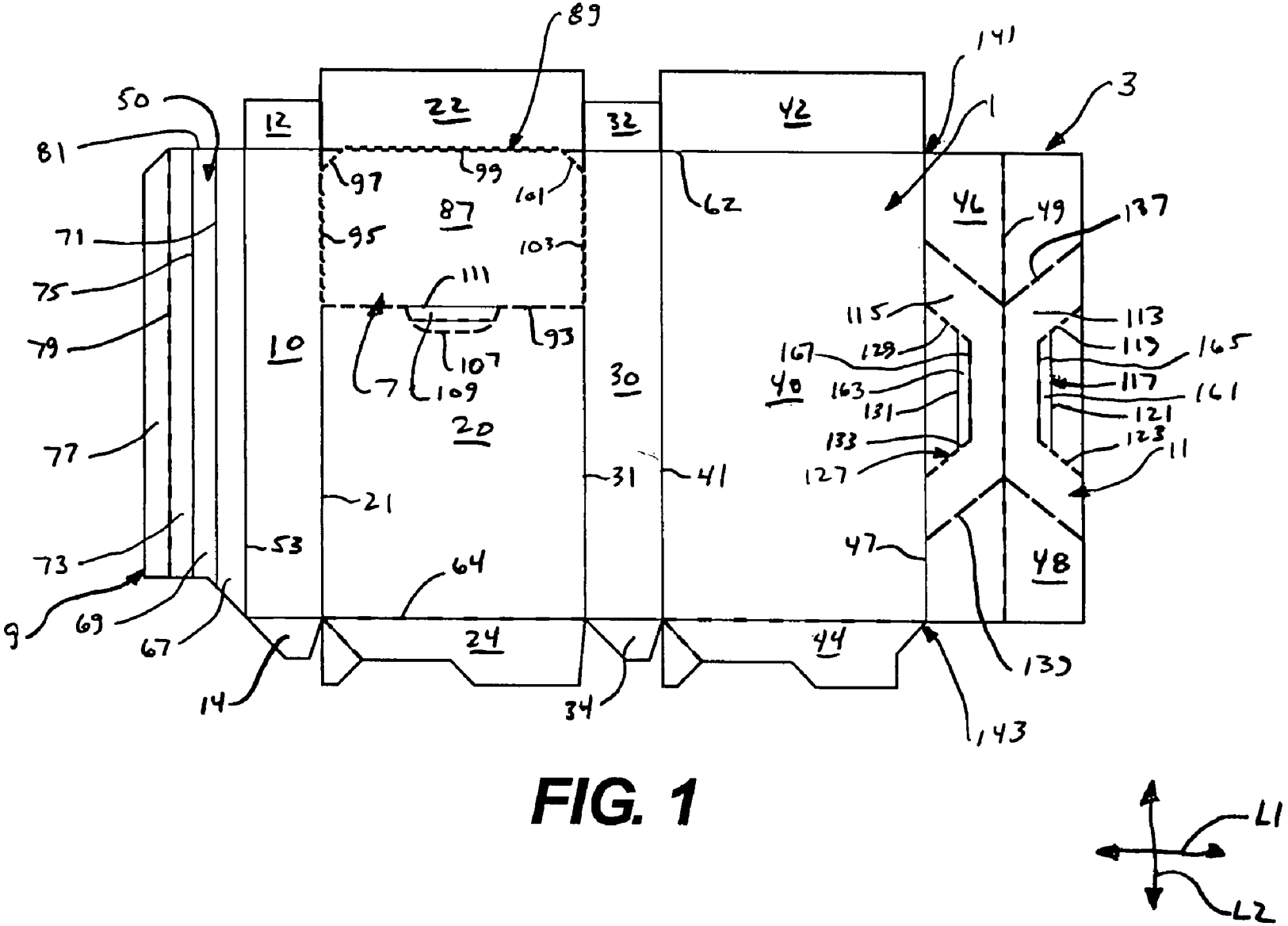
FIG. 1 is a plan view of a blank used to form a carton according to a first embodiment of the invention.
Figure 7:
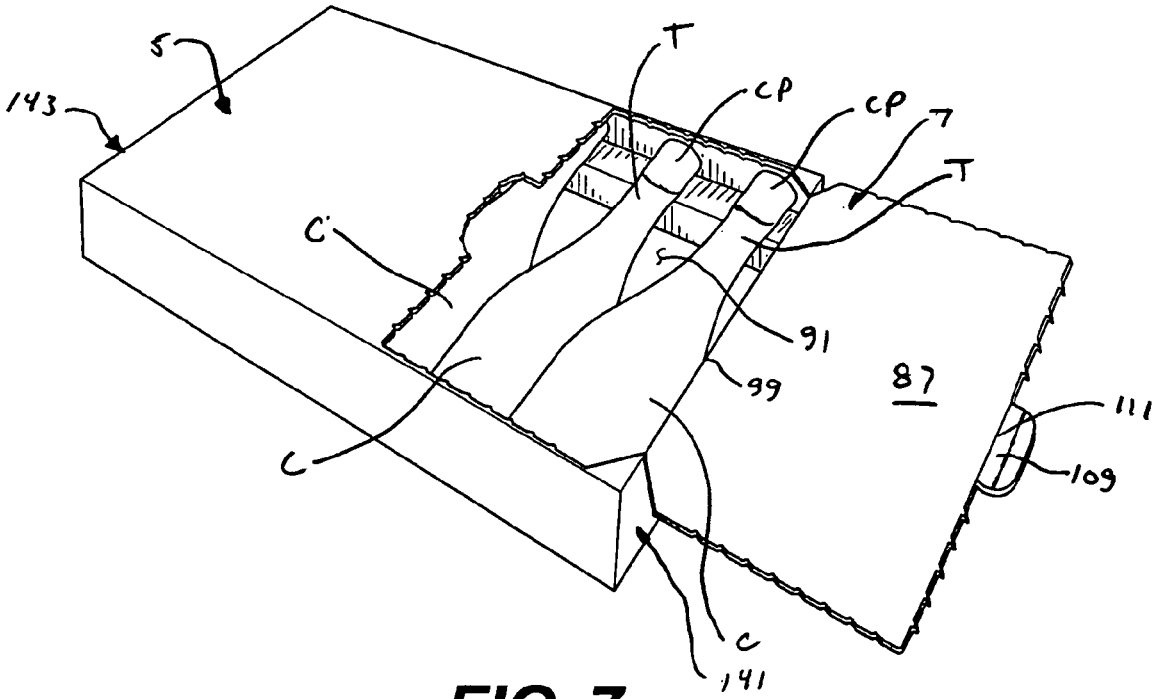
FIG. 7 is a perspective showing the dispenser fully opened and the containers aligned for dispensing.
Figure 8:
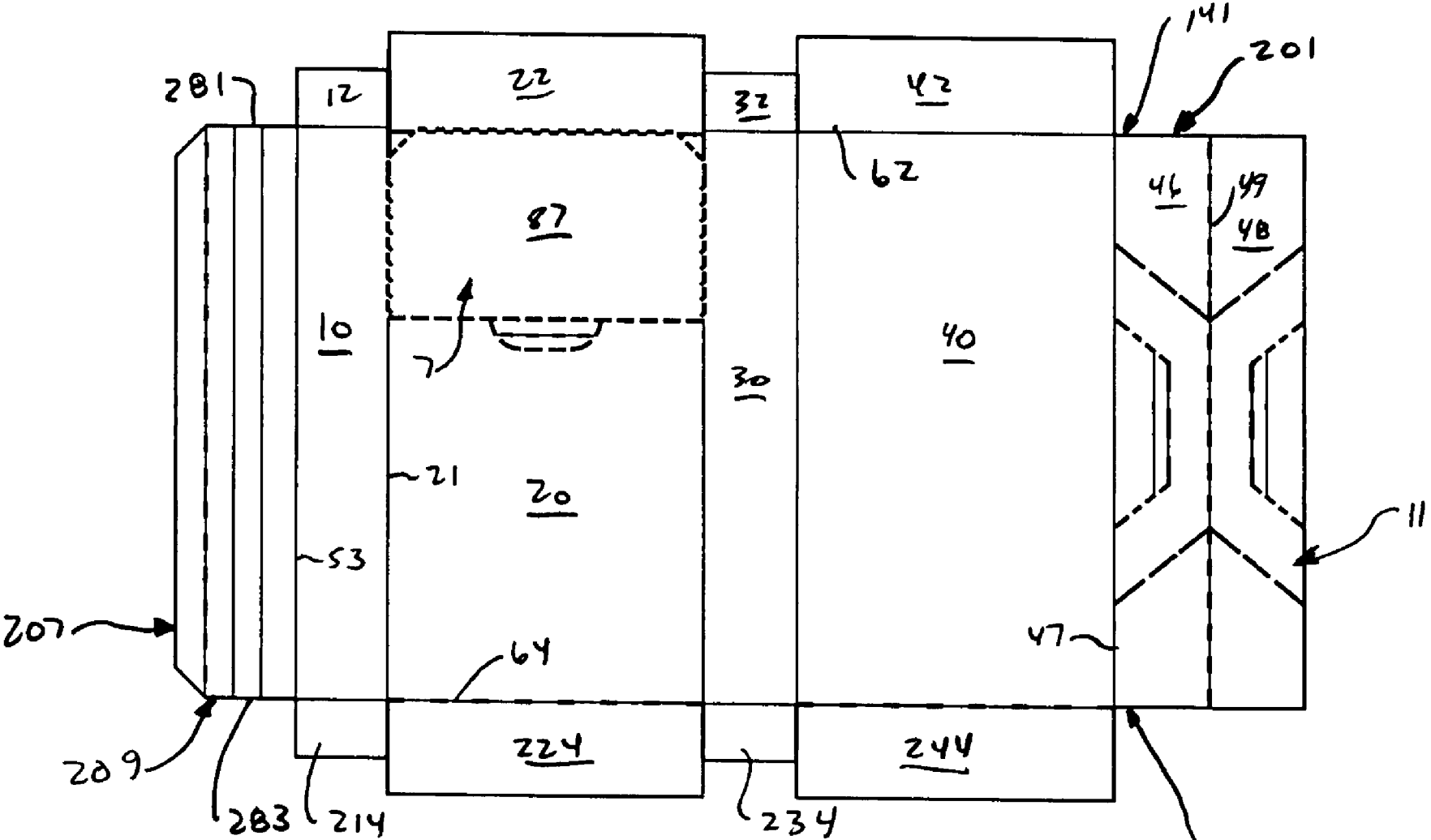
FIG. 8 is a plan view of a blank used to form a carton according to a second embodiment of the invention.

FIG. 1 is a plan view of the exterior side 1 of a blank, generally indicated at 3, used to form a carton 5 according to the exemplary embodiment of the invention. The carton 5 can be used to house a plurality of articles such as containers C (FIGS. 3 and 8). The carton 5 has a dispenser, generally indicated at 7 (FIG. 7), formed in the carton for allowing access to the containers C. In the illustrated embodiment, the containers C are bottles having a wide bottom B and a narrow top T including a cap CP in contact with the support when the bottles are loaded in the container. The carton 5 includes a support 9 (FIG. 2) for supporting the top T of the containers C in the carton. In the illustrated embodiment, the carton 5 is sized to house containers C in a single layer in a 1×6 arrangement, but it is understood that the carton 5 may be sized and shaped to hold containers of a different or same quantity in more than one layer and/or in different row/column arrangements (e.g., 2×6, 3×6, 2×6×2, 3×4×2, etc.). In the illustrated embodiment, the carton 5 includes a handle, generally indicated at 11 (FIGS. 5 and 6), for grasping and carrying the carton.

The blank 3 has a longitudinal axis L1 and a lateral axis L2. In the illustrated embodiment, the blank 3 comprises a first top panel 10 foldably connected to a first side panel 20 at a first lateral fold line 21, a bottom panel 30 foldably connected to the first side panel 20 at a second lateral fold line 31, a second side panel 40 foldably connected to the bottom panel 30 at a third lateral fold line 41, a second top panel 46 foldably connected to the second side panel 40 at a fourth lateral fold line 47, and a third top panel 48 foldably connected to the second top panel at a fifth lateral fold line 49. The support 9 includes a support panel, generally indicated at 50 foldably attached to the first top panel 10 at a sixth lateral fold line 53.

The first top panel 10 is foldably connected to a first top end flap 12 and a second top end flap 14. The first side panel 20 is foldably connected to a first side flap 22 and a second side flap 24. The bottom panel 30 is foldably connected to a first bottom end flap 32 and a second bottom end flap 34. The second side panel 40 is foldably connected to a first side flap 42 and a second side flap 44. When the carton 5 is erected, the end flaps 12 and 32 and side flaps 22 and 42 close a first 141 end 143 of the carton, and the end flaps 14 and 34 and side flaps 24 and 44 close a second end of the carton. In accordance with an alternative embodiment of the present invention, different flap arrangements can be used for closing the ends 141, 143 of the carton 5.

The end flaps 12 and 32 and side flaps 22 and 42 extend along a first marginal area of the blank 1, and are foldably connected at a first longitudinal fold line 62 that extends along the length of the blank. The end flaps 14 and 34 and side flaps 24 and 44 extend along a second marginal area of the blank 1, and are foldably connected at a second longitudinal fold line 64 that also extends along the length of the blank. The longitudinal fold lines 62, 64 may be, for example, substantially straight, or offset at one or more locations to account for blank thickness or for other factors.

In the illustrated embodiment, the support panel 50 includes a first foldable panel 67 foldably attached to the first top panel 10 at the lateral fold line 53, a second foldable panel 69 foldably attached to the first foldable panel at a lateral fold line 71, a third foldable panel 73 foldably attached to the second foldable panel at a lateral fold line 75, and a fourth foldable panel 77 foldably attached to the third foldable panel at a lateral fold line 79. As will be discussed below in more detail, the four foldable panels 67, 69, 73, 77 are foldable relative to each other so that the third foldable panel forms a shoulder for contacting the narrow top T of the containers C housed in the carton 5. As shown in FIG. 1, the first, second, and third foldable panels 67, 69, 73 have a first lateral end 81 aligned with the longitudinal fold line 62 of the blank 3.

Figure 6:
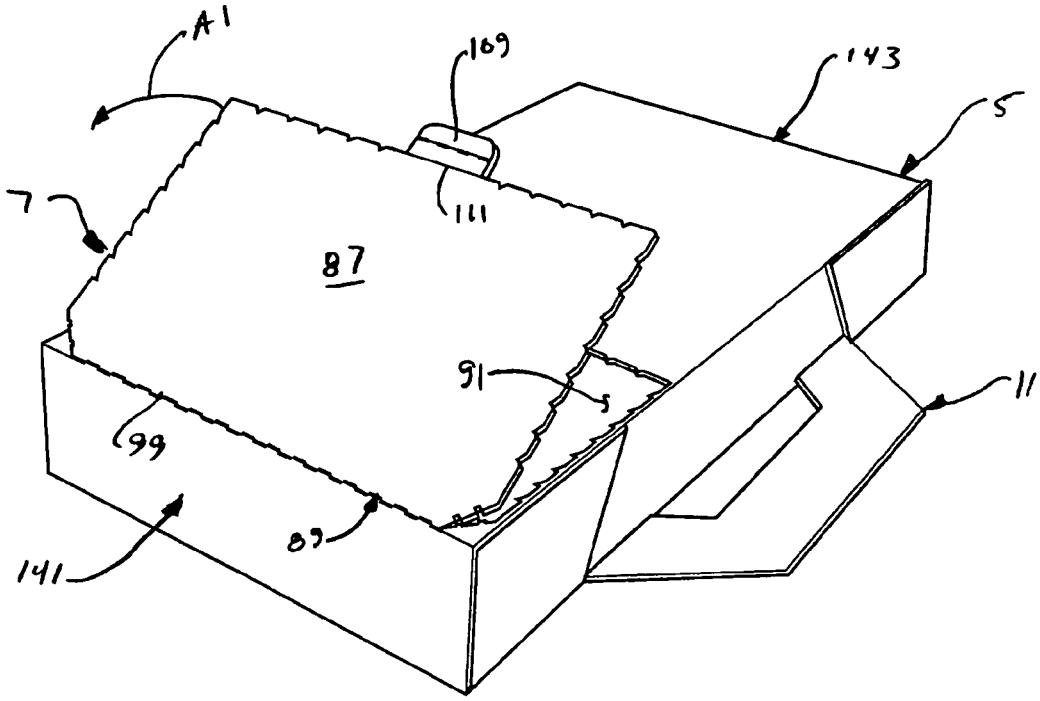
FIG. 6 is a perspective of the carton showing a dispenser panel partially opened.

The dispenser 7 includes a dispenser panel 87 removably attached to the blank 3 at a tear line, generally indicated at 89. As shown in FIGS. 6 and 7, the dispenser 7 includes an opening 91 in the carton 5 to allow containers C to be removed from the carton. In the illustrated embodiment, the dispenser panel 87 is a generally rectangular panel formed in the first side panel 20 of the blank 3 and having two angled corners, but it is understood that the dispenser panel could comprise other shapes and could include other panels or side and end flaps of the blank without departing from the scope of this invention. As shown in FIG. 1, the tear line 89 includes a first longitudinal portion 93 in the first side panel 20, a first lateral portion 95 corresponding with a portion of the lateral fold line 21, a first oblique portion 97 between the lateral fold line 21 and the longitudinal fold line 62, a second longitudinal portion 99 corresponding with a portion of the longitudinal fold line 62, a second oblique portion 101 between the longitudinal fold line 62 and the lateral fold line 31, and a second longitudinal portion 103 corresponding with a portion of the lateral fold line 31. In the illustrated embodiment, the dispenser 7 includes a curved tear line 107 forming a finger panel 109 adjacent the first longitudinal portion 93 of the tear line 89. The finger panel 109 is foldably connected to the dispenser panel 87 by a fold line 111 that segregates the first longitudinal portion 93 of the tear line 89 and extends between the two ends of the curved tear line 107.

As shown in FIG. 1, the handle 11 includes a first handle panel 113 formed in the third top panel 48 of the blank 3, and a second handle panel 115 formed in the second top panel 46 and foldably attached to the first handle panel at a portion of the lateral fold line 49. As shown in FIG. 1, the first and second handle panels 113, 115 are in generally mirror-image relationship with each other along the portion of the lateral fold line 49. The inner edge of the first handle panel 113 is formed by a tear line, generally indicated at 117, having a first oblique portion 119 extending from a longitudinal edge of the blank 3, a lateral portion 121 generally parallel to the lateral fold line 49, and a second oblique portion 123 extending from the lateral portion of the fold line to the longitudinal edge of the blank. The inner edge of the second handle panel 115 is formed from a tear line, generally indicated at 127, similarly shaped as the tear line 117 having a first oblique portion 129, a lateral portion 131, and a second oblique portion 133. The outer lateral edges of the two handle panels 113 and 115 are formed by respective v-shaped tear lines 137, 139 in the second and third top panels 46, 48 of the blank 3. Each handle panel 113, 115 includes a respective foldable panel 161, 163 connected to the handle panel at a respective lateral fold line 165, 167. Each foldable panel 161, 163 can be folded about a respective fold line 165, 167 to provide a wider handle opening 171 (FIG. 5) and more comfortable fit to a user's hand. It is understood that the handle panels 113, 115 could have other shapes and/or that only a single handle panel may be formed in the blank 3 without departing from the scope of this invention.

In accordance with the exemplary embodiment, the blank 3 can be erected into the carton 5 by folding along fold lines 21, 31, 41, 47, 49, 53 and adhering the first top panel 10 to the third top panel 48 to form a sleeve. In one embodiment, the support 9 (FIG. 2) is formed prior joining the top panels 10, 48 by first folding the support panel 50 along fold line 53 so the support panel is positioned at a right angle relative to the first top panel 10. Next, the second foldable panel 69 of the support panel 50 is folded at lateral fold line 71 to be positioned at a right angle relative to the first foldable panel 67 so that the second foldable panel is generally parallel to the first top pane 10. Next, the third foldable panel 73 is folded at lateral fold line 75 so that the third foldable panel is perpendicular to the second foldable panel 69 and generally parallel to the first foldable panel 67. The fourth foldable panel 77 is then folded along fold line 79 so that the fourth panel is perpendicular to the third panel 73 and the fourth panel is adhered to the first top panel 10 by adhesive such as glue to attach the support 9 to the first top panel. The resulting configuration of the support 9 is illustrated in FIGS. 2 and 3.

In the illustrated embodiment, the third top panel 48 is folded along lateral fold line 49 to overlap the second top panel 46 and is adhesively attached to the second top panel by glue to erect the carton 5. The adhesively attached second and third top panels 46, 48 are then folded along lateral fold line 47 to overlap the first top panel 10 with the first top panel being adhesively attached to the third top panel 48 with glue to form the generally open ended sleeve. It is understood that the overlapped first and second handle panels 113, 115 remain free from adhesive attachment to the first top panel 10 to allow the handle 11 to be free to pivot upward relative to the first top panel.

Figure 4:
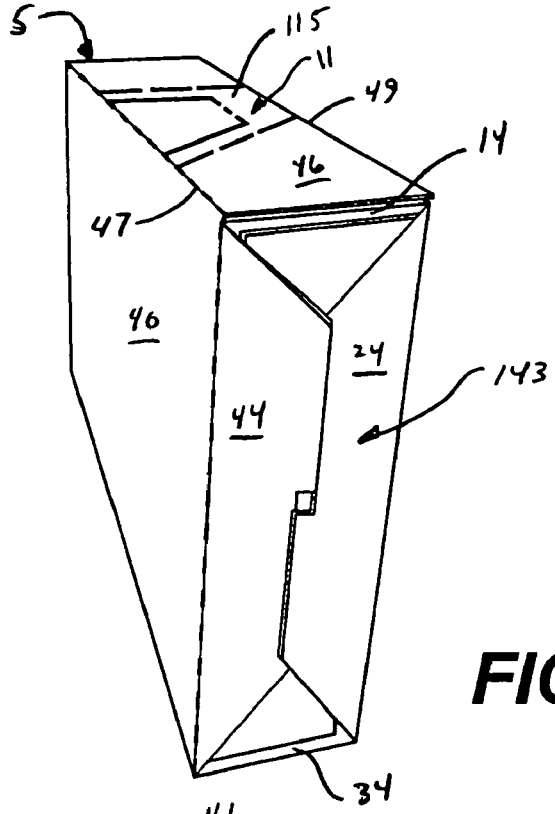
FIG. 4 is a perspective of the carton showing a closed second end of the carton.

In the illustrated embodiment, the first end 141 of the carton 5 is closed by respectively overlapping and adhering the end flaps 12, 32, and side flaps 22, 42 after the containers C are inserted into the carton. The second end 143 of the carton is closed by respectively overlapping the end flaps 14, 34 and side flaps 24, 44. As shown in FIG. 4, the side flaps 24, 44 are shaped for interlocking engagement to form the closed end 143 of the carton 5 without the need for adhesive between the side flaps. The flaps 24, 44 may be attached to a respective end flap 14, 34 by adhesive to form the closed end 143. The interlocking side flaps 24, 44 allow the second end 143 of the carton 5 to be closed automatically (i.e., without an additional step of overlapping and gluing the side flaps together) upon formation of the sleeve shown in FIG. 2. Once the blank 3 is formed into a sleeve, the containers C may be loaded in the carton 5 from the first end 141 and then the first end may be closed by overlapping and gluing the end flaps 12, 32 and side flaps 22, 42. It is understood that the carton 5 may have other closing arrangements for the first and second ends 141, 143.

Figure 2:
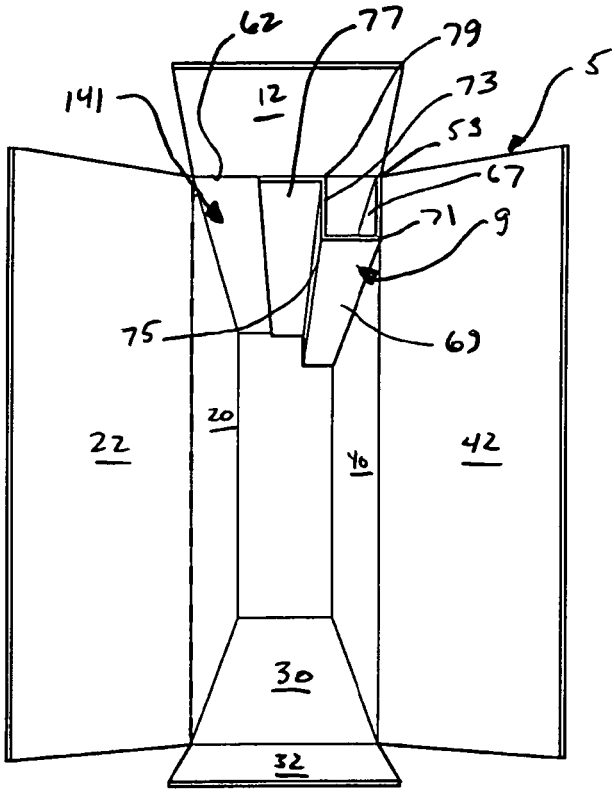
FIG. 2 is an end view of a first open end of a carton formed from the blank of FIG. 1.
Figure 3:
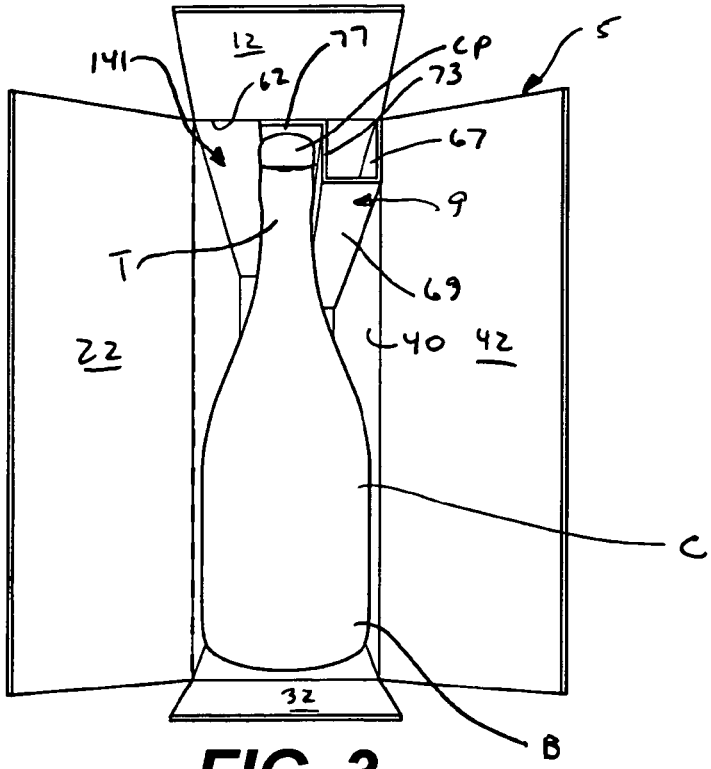
FIG. 3 is a view similar to FIG. 2 but showing a container loaded in the carton.

As shown in FIGS. 2 and 3, the support 9 is spaced apart from the side panel 40 to form a shoulder for contacting the cap CP of the container C, such as to support the container and limit the movement of the narrow top portion T of the container between the side walls 20, 40. The third foldable panel 73 forms the shoulder of the support 9 that extends substantially the length of the carton 5 so that the narrow top T of all the containers C housed in the carton 5 are supported by the support. As shown in FIGS. 2 and 3, the support 9 has a generally square or rectangular cross-sectional shape and is positioned generally adjacent the longitudinal fold line 62 forming the first end 141 of the carton 5. In one embodiment, the support 9 is positioned adjacent the fold line 62 to prevent the top end flap 12 from being folded past a generally horizontal plane when the end 141 is closed (as viewed in FIG. 2). When the first end 141 of the carton 5 is closed, the top end flap 12 is pressed against the longitudinal end of the support 9 so that adhesive can be applied on the outside of the top end flap by the carton forming machine forming the closed end 141 of the carton. In this way, the support 9 acts as a stopper to allow the carton forming machine to apply glue to the top end flap 12 by pressing the top end flap against the longitudinal end of the support 9. It will be understood that the support 9 may be otherwise shaped without departing from the scope of this invention.

As shown in FIGS. 6 and 7, the dispenser panel 87 may be removed from the carton 5 to form the dispenser opening 91. An exemplary opening process can begin with pressing against the finger panel 109 to tear the dispenser panel along the curved tear line 107 and fold the finger panel inward along fold line 111. Once the finger panel 109 is folded inward, the dispenser panel 87 is grasped and pulled in the direction of arrow A1 (FIG. 6) to tear the carton 5 along the tear line 89 to pivot the dispenser panel at the second longitudinal portion 99 of the tear line and position the dispenser 7 in the position shown in FIG. 7. It is understood that the dispenser panel 87 may be removed from the carton 5 by tearing the panel at the second longitudinal portion 99 of the tear line 89. Once the dispenser panel 87 is removed, containers C may be removed through opening 91 in the carton 5. It is understood that the dispenser panel 87 and tear line 89 may be otherwise sized and shaped to correspond with various other sizes and shapes of containers C which may be housed in the carton 5 and to form other sizes and locations of the opening 91.

Figure 5:
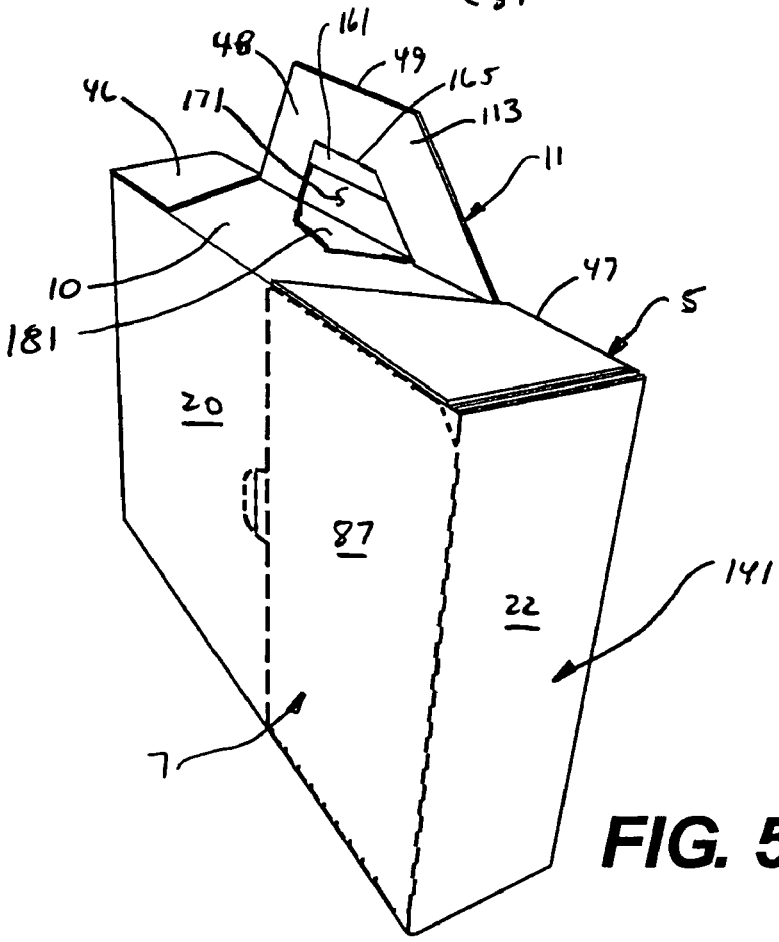
FIG. 5 is a perspective of the assembled and closed carton.

As shown in FIG. 5, the handle 11 may be pivoted to the upright position to facilitate grasping of the carton 5. The handle 11 may be grasped along the portion of the lateral fold line 49 that joins the first handle panel 113 with the second handle panel 115. The overlapped handle panels 113, 115 are pivoted about the lateral fold line 47 so that the handle 11 is positioned generally parallel to the side panels 20, 40 of the carton 5. In the pivoted portion of FIG. 5, the handle opening 171 is formed by the portion 181 of the overlapped top panels 46, 48 that remains attached to the first top panel 10. The overlapped foldable panels 161, 163 may be upwardly folded to increase the size of the handle opening 171. The handle 11 including the overlapped handle panels 113, 115 includes two layers of material to provide a reinforced handle for carrying the carton. It is understood that the handle 11 could include other shapes, sizes, and configurations of handles or the handle could be omitted from the carton 5 without departing from the scope of this invention.

FIG. 8 shows a second embodiment of a blank, generally indicated at 201, of the present invention. The blank 201 can be used to form a carton (not shown) substantially similar to the carton 5 having a support 9, dispenser 7 and handle 11. The blank 201 is similar to the blank 3 except the second end 243 of the blank includes overlapping side flaps 224, 244 and overlapping end flaps 214, 234. It is understood that the second end 203 of the blank 201 is closed in a similar way as the first end 141 of the blank 3 described above for the first embodiment. The support 209 of the second embodiment is formed from a support panel 207 similar to the support panel 50 of the first embodiment but having a first lateral edge 281 adjacent the first longitudinal fold line 62 and a second lateral edge 283 adjacent the second longitudinal fold line 64. When the second end 243 of the carton formed from the blank 201 is closed, the top end flap 214 may be pressed against the second lateral edge 283 of the support so that glue may be applied to the outer surface of the top end flap for adhesive attachment of one of the side flaps 224, 244 to the top end flap.

The present invention can be used in cartons that include various features, including additional opening features that provide easy access to the articles, and tilt features that position the articles at the front or rear end of the carton.

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton for containing a plurality of articles, the carton comprising:

panels that extend at least partially around an interior of the carton, the panels include a top panel, a bottom panel and a first side panel and a second side panel;

a support adjacent and foldably connected to the top panel and projecting into the interior of the carton for at least partially supporting the plurality of articles within the carton, wherein the support comprises a first foldable panel generally parallel to at least one of the first and second side panels and a second foldable panel generally parallel to at least one of the top and bottom panels, the first foldable panel being foldably attached to the second foldable panel and forming a shoulder for contacting the plurality of articles, end flaps respectively foldably attached to respective panels of the plurality of panels at a fold line, wherein the end flaps at least partially form a closed end of the carton and the support has an end positioned adjacent the fold line for contact with at least one of the end flaps when the first closed end is formed, the end of the support restricting the at least one of the end flaps from being folded into the carton when the end flaps form the closed end, and a handle foldably attached to the top panel, the top panel is a first top panel and the carton comprises a second top panel and a third top panel, the support being foldably attached to the first top panel, the handle comprises a first handle panel in the third top panel and a second handle panel in the second top panel, the second handle panel being overlapped and adhered to the first handle panel.

2. The carton of claim 1 wherein said support comprises a third foldable panel foldably attached to the second foldable panel and being generally parallel to at least one of the first and second side panels, and a fourth foldable panel foldably attached to the third foldable panel and being generally parallel to the top panel.

3. The carton of claim 2 wherein said fourth foldable panel is adhesively attached to the top panel.

4. The carton of claim 1 wherein the support extends approximately the length of the carton.

5. The carton of claim 2 wherein the first foldable panel is foldably attached to the top panel, the articles comprise a plurality of beverage containers each having a cap at a top of the containers, and the third foldable panel and the fourth foldable panel are for contacting a cap of each of the containers to limit movement of the containers between the first and second side panels.

6. The carton of claim 1 wherein:

the closed end is a first closed end;

the end flaps are first end flaps that are overlapped with respect to one another to form the first closed end;

the carton further includes at least two second end flaps respectively foldably attached to respective panels of the plurality of panels, wherein the second end flaps are interlocking end flaps that interlock with respect to one another and thereby at least partially form a second closed end of the carton.

7. The carton of claim 6 wherein the first end flaps are adhesively connected to form the closed end.

8. The carton of claim 1 wherein the carton has a dispenser removably attached to at least one of the panels, the dispenser comprising an at least partially removable panel for forming an opening for selective removal of articles from the package.

9. The carton of claim 8 wherein said at least partially removable panel is removably attached to at least one of the side panels.

10. A blank for forming a carton having a support for supporting a plurality of articles, the blank comprising: a plurality of panels including a top panel, a bottom panel, a first side panel and a second side panel; end flaps respectively foldably attached to respective panels of the plurality of panels at a fold line, wherein the end flaps at least partially form a closed end of the carton; and a support panel foldably attached to the top panel for being formed into the support for at least partially supporting the plurality of articles in a carton erected from the blank, the support panel comprises a first foldable panel foldably attached to a second foldable panel, the first foldable panel for being positioned generally parallel to at least one of the first and second side panels in the carton erected from the blank and the second foldable panel for being positioned generally parallel to at least one of the top and bottom panels in the carton erected from the blank, wherein the first foldable panel is for forming a shoulder for contacting the plurality of articles in the carton erected from the blank; the support has an end positioned adjacent the fold line for contact with at least one of the end flaps when the closed end is formed, the end of the support restricting the at least one of the end flaps from being folded into the carton when the end flaps form the closed end; wherein the top panel is a first top panel and the blank comprises a second top panel and a third top panel, the support panel being foldably attached to the first top panel, and the blank comprising a handle foldably attached to the second top panel; wherein the handle comprises a first handle panel in the third top panel and a second handle panel in the second top panel, the first and second handle panels being foldably connected at a lateral fold line.

11. The blank of claim 10 wherein the support extends approximately the lateral length of the blank.

12. The blank of claim 10 wherein the end flaps are foldably connected to the panels at a longitudinal fold line and the support panel has a lateral edge adjacent the longitudinal fold line.

13. The blank of claim 10 further comprising a dispenser panel at least partially removably attached to the blank by a tear line extending at least in part in at least one of the side panels.

14. The blank of claim 10 wherein the blank has a handle panel foldably attached to the top panel.

15. The blank of claim 10 wherein the support panel comprises a third foldable panel foldably attached to the second foldable panel and a fourth foldable panel foldably attached to the third foldable panel, the second, third, and fourth foldable panels being foldably attached to the top panel by way of the first foldable panel.

16. The blank of claim 10 wherein said first handle panel is removably attached to the third top panel by a tear line and the second handle panel is removably attached to the second top panel by a line.

17. A method of forming a carton from a blank comprising:

providing a blank comprising a top panel, a bottom panel, a first side panel and a second side panel, end flaps respectively foldably attached to respective panels of the plurality of panels at a fold line, and a support panel foldably attached to the top panel, the support panel comprises a first foldable panel foldably attached to a second foldable panel, wherein the first foldable panel is for forming a shoulder for contacting a plurality of articles in the carton formed from the blank, the support panel has an end positioned adjacent the fold line;

forming a support by folding the support panel relative to the top panel wherein the first foldable panel is positioned generally parallel to at least one of the first and second side panels and the second foldable panel is positioned generally parallel to at least one of the top and bottom panels in the carton erected from the blank;

attaching the support panel to the top panel; and forming a sleeve that extends at least partially around the support; and closing the carton by folding the end flaps to at least partially form a closed end of the sleeve by contacting at least one of the end flaps with the end of the support, the end of the support restricting the at least one of the end flaps from being folded into the carton when the end flaps form the closed end, the support panel further comprises a third foldable panel foldably attached to the second foldable panel, and a fourth foldable panel foldably attached to the third foldable panel, forming said support comprises folding the first foldable panel relative to the top panel, folding the second foldable panel relative to the first foldable panel, folding the third foldable panel relative to the second foldable panel, folding the fourth foldable panel relative to the third foldable panel, attaching the support panel comprises adhesively attaching the fourth foldable panel to the top panel, and forming the support includes positioning the first foldable panel, second foldable panel, and third foldable panel such that the support has a rectangular cross-sectional shape.

18. The method of claim 17 wherein the top panel is a first top panel and said blank comprises a second top panel foldably connected to the second side panel and a third top panel foldably connected to the second top panel, the method further comprising forming a handle from the second top panel and third top panel.

19. The method of claim 18 wherein the third top panel comprises a first handle panel and the second top panel comprises a second handle panel, wherein forming the handle comprises overlapping and attaching the first handle panel and the second handle panel and pivoting the attached first and second handle panels relative to the first top panel to position the handle in an upright position.

20. The method of claim 17 wherein said sleeve has a first open end and a second open end, the method further comprising closing the first end and closing the second end.

21. The method of claim 17 wherein the end flaps comprise top end flaps and closing the first end of the sleeve comprises folding the top end flap and pressing the top end flap against a longitudinal end of the support.

22. The method of claim 21 wherein the end flaps further comprise side end flaps and closing the first end comprises applying adhesive to at least one of the top end flaps and overlapping and adhesively bonding at least one of the side end flaps with at least one of the top end flap.

* * * * *